US011236759B2

(12) United States Patent
Uffelman

(10) Patent No.: US 11,236,759 B2
(45) Date of Patent: Feb. 1, 2022

(54) CONTOURED FAN BLADES AND ASSOCIATED SYSTEMS AND METHODS

(71) Applicant: Dri-Eaz Products, Inc., Burlington, WA (US)

(72) Inventor: Alexander John Uffelman, Bellingham, WA (US)

(73) Assignee: Legend Brands, Inc., Burlington, WA (US)

( * ) Notice: Subject to any disclaimer, the term of this patent is extended or adjusted under 35 U.S.C. 154(b) by 2 days.

(21) Appl. No.: 16/667,752

(22) Filed: Oct. 29, 2019

(65) Prior Publication Data

US 2020/0173458 A1 Jun. 4, 2020

Related U.S. Application Data

(60) Provisional application No. 62/752,173, filed on Oct. 29, 2018.

(51) Int. Cl.
*F04D 29/38* (2006.01)
*F28F 5/00* (2006.01)

(52) U.S. Cl.
CPC ..... *F04D 29/384* (2013.01); *F04D 29/388* (2013.01); *F05B 2250/184* (2013.01); *F05B 2260/221* (2013.01); *F28F 5/00* (2013.01); *F28F 2250/08* (2013.01)

(58) Field of Classification Search
CPC ..... F04D 29/384; F04D 29/388; F05D 2240/303; F05D 2240/304; F05D 2240/305; F05D 2240/306; F05D 2250/184; F05D 2250/61; F05D 2250/611
See application file for complete search history.

(56) References Cited

U.S. PATENT DOCUMENTS 108,949 A 11/1870 Wheeler
D184,468 S 2/1959 Wistrand
2,899,128 A * 8/1959 Vaghi ..... F04D 29/384 415/222
3,319,786 A 5/1967 Rudolf
(Continued)

FOREIGN PATENT DOCUMENTS

GB 1558297 A 12/1979
GB 2227943 A 8/1990
(Continued)

OTHER PUBLICATIONS

Dri-Eaz F504 Velo Low Profile Air Mover AKA Velos, Mar. 12, 2013, 3 pages.
(Continued)

*Primary Examiner* — Ninh H. Nguyen
(74) *Attorney, Agent, or Firm* — Perkins Coie LLP

(57) ABSTRACT

Contoured fan blades and associated systems and methods are disclosed herein. A representative embodiment includes a hub and multiple curved fan blades circumferentially arranged around, and coupled to, the hub. Individual fan blades can have a tip, a first curved edge, and a second curved edge. The first and second curved edges extend over at least part of the length between the hub to the tip of the fan blade. The fan blade is formed with multiple upper channels and multiple lower channels. The multiple upper and lower channels extend from the first curved edge to the second curved edge.

19 Claims, 12 Drawing Sheets

(56) References Cited

U.S. PATENT DOCUMENTS

| | | | | |
|---|---|---|---|---|
| 3,333,345 | A | 8/1967 | Miller | |
| 3,510,958 | A | 5/1970 | Van Der Lely | |
| D243,243 | S | 2/1977 | Nagao et al. | |
| D254,566 | S | 3/1980 | Cummins | |
| 4,572,188 | A | 2/1986 | Augustine et al. | |
| 4,830,315 | A * | 5/1989 | Presz, Jr. | F01D 5/141 244/200 |
| 5,030,068 | A | 7/1991 | Jacobs et al. | |
| 5,155,924 | A | 10/1992 | Smith | |
| 5,174,048 | A | 12/1992 | Shero | |
| 5,208,940 | A | 5/1993 | London et al. | |
| D340,326 | S | 10/1993 | Genovese | |
| 5,257,467 | A | 11/1993 | White | |
| 5,265,895 | A | 11/1993 | Barrett | |
| 5,403,152 | A | 4/1995 | Trautloff et al. | |
| 5,405,370 | A | 4/1995 | Irani | |
| 5,893,216 | A | 4/1999 | Smith et al. | |
| D409,737 | S | 5/1999 | Nilsson | |
| 5,950,331 | A | 9/1999 | Coggins et al. | |
| 5,954,494 | A | 9/1999 | Goldsmith et al. | |
| 5,991,973 | A | 11/1999 | Simpson | |
| 6,024,543 | A | 2/2000 | Lambertson | |
| D422,351 | S | 4/2000 | Griffin | |
| 6,195,907 | B1 | 3/2001 | Bodnar et al. | |
| 6,202,322 | B1 | 3/2001 | Turner, IV | |
| D440,298 | S | 4/2001 | Wolfe | |
| D442,740 | S | 5/2001 | Wolfe | |
| 6,367,625 | B1 | 4/2002 | Zobel | |
| 6,401,354 | B1 | 6/2002 | Johnson | |
| D468,726 | S | 1/2003 | Shimokawatoko et al. | |
| D480,467 | S | 10/2003 | White | |
| D484,586 | S | 12/2003 | Intravatola | |
| D488,857 | S | 4/2004 | Wintersteen et al. | |
| 6,739,070 | B1 | 5/2004 | Jacobs et al. | |
| D497,664 | S | 10/2004 | Puri | |
| D503,971 | S | 4/2005 | Otaki | |
| 6,899,516 | B2 | 5/2005 | Wang | |
| 6,908,287 | B2 * | 6/2005 | Cho | F04D 29/326 415/119 |
| D517,677 | S | 3/2006 | Bartholmey | |
| 7,007,403 | B1 | 3/2006 | Studebaker | |
| D526,751 | S | 8/2006 | Hendy | |
| 7,090,710 | B2 | 8/2006 | Choi | |
| D533,322 | S | 12/2006 | Blateri | |
| D536,432 | S | 2/2007 | Jackovitch et al. | |
| D537,153 | S | 2/2007 | Hoog et al. | |
| D537,156 | S | 2/2007 | Marengo et al. | |
| D537,517 | S | 2/2007 | Hancock | |
| 7,173,353 | B2 | 2/2007 | Lopatinsky et al. | |
| D565,162 | S | 3/2008 | Carlson | |
| D576,266 | S | 9/2008 | Yamakami | |
| 7,460,370 | B2 | 12/2008 | Cheng et al. | |
| D607,622 | S | 1/2010 | Blateri | |
| 7,699,587 | B2 | 4/2010 | Chapman et al. | |
| D619,698 | S | 7/2010 | Emenheiser et al. | |
| 7,785,064 | B2 | 8/2010 | Bartholmey et al. | |
| D625,799 | S | 10/2010 | Salisbury et al. | |
| 7,861,708 | B1 | 1/2011 | Lyons | |
| 8,186,974 | B2 | 5/2012 | Lan et al. | |
| 8,296,968 | B2 | 10/2012 | Hensley | |
| 8,342,800 | B2 | 1/2013 | Cvjeticanin | |
| D691,336 | S | 10/2013 | Griffin et al. | |
| D698,433 | S | 1/2014 | Tomasiak et al. | |
| D704,908 | S | 5/2014 | Cui | |
| D714,922 | S | 10/2014 | Speh | |
| 9,121,638 | B2 | 9/2015 | Black et al. | |
| 2004/0047743 | A1 | 3/2004 | Dooley et al. | |
| 2004/0231181 | A1 | 11/2004 | Coven | |
| 2004/0255484 | A1 | 12/2004 | Storrer et al. | |
| 2005/0084400 | A1 | 4/2005 | Tsai | |
| 2006/0049615 | A1 | 3/2006 | Day | |
| 2006/0056965 | A1 | 3/2006 | Li et al. | |
| 2006/0186225 | A1 | 8/2006 | Bartholmey et al. | |
| 2007/0051007 | A1 | 3/2007 | Reets et al. | |
| 2007/0157485 | A1 | 7/2007 | Andrisin et al. | |
| 2007/0183940 | A1 | 8/2007 | Yamamoto et al. | |
| 2008/0232958 | A1 | 9/2008 | Weyandt | |
| 2009/0304492 | A1 | 12/2009 | Bartholmey et al. | |
| 2010/0040456 | A1 | 2/2010 | Hwang et al. | |
| 2012/0233804 | A1 | 9/2012 | Studebaker et al. | |
| 2013/0247409 | A1 | 9/2013 | Black et al. | |
| 2014/0325865 | A1 | 11/2014 | Wisherd et al. | |
| 2019/0024674 | A1 * | 1/2019 | Loercher | F04D 29/324 |

FOREIGN PATENT DOCUMENTS

| | | | |
|---|---|---|---|
| GB | 2397366 | A | 7/2004 |
| GB | 2416676 | A | 2/2006 |
| GB | 2422192 | A | 7/2006 |
| GB | 2423810 | A | 9/2006 |
| JP | 2004261788 | A | 9/2004 |
| SU | 1709951 | A1 | 2/1992 |
| WO | WO-8900622 | A1 | 1/1989 |
| WO | WO-2008137188 | A1 | 11/2008 |

OTHER PUBLICATIONS

Dri-Eaz, Product Catalog, Jan. 1, 2002, pp. 4-7 and 14, Burlington, Washington, U.S.

Dri-Eaz, Product Catalog, Jan. 1, 2002, pp. 9-12; Burlington, Washington, U.S.

Dri-Eaz, Product Catalog, Jan. 1, 2003, p. 10, Burlington, Washington, U.S.

Jon-Don; Gale Force Air Mover from Dry-Air at Jon-Don; www.jondon.com/galeforce/; Mar. 2003.

* cited by examiner

CONTOURED FAN BLADES AND ASSOCIATED SYSTEMS AND METHODS

CROSS-REFERENCE TO RELATED APPLICATION

The present application claims priority to U.S. Provisional Application No. 62/752,173, filed on Oct. 29, 2018 and incorporated herein by reference.

TECHNICAL FIELD

The present technology is directed generally to contoured fan blades and associated systems and methods. More particularly, the present technology discloses curved (e.g., along a sine wave) fan blades used in dehumidifiers, air movers, fans, and other devices/systems with similar functions.

BACKGROUND

The shape of a fan blade affects its aerodynamic characteristics. Existing rotating blades with a flat surface design may generate turbulence, which may lower the blade's air-moving efficiency. In some cases, rotating such existing blades may cause uneven or non-uniform airflow (e.g., as shown in FIG. 4A), which may cause uneven airflow and/or uneven cooling. Therefore, there remains a need for improved fan blade designs to address these problems.

DETAILED DESCRIPTION

The present technology is directed generally to fan blades and corresponding systems, devices, and methods for manufacturing the same. Fan blades configured in accordance with embodiments of the disclosed technology can be used to effectively generate airflow and/or move air in a predetermined direction.

In general terms, the fan blades disclosed herein are configured to move a fluid (in some embodiments, air or another gas, a liquid, and/or a combination thereof) in an efficient way by mitigating or decreasing undesirable vortices, turbulence, and/or eddies. The present technology can effectively reduce noise and/or vibrations caused by these undesirable vortices and accordingly improve the overall efficiency of the blade.

Several details describing structures/apparatus/systems that are well-known and often associated with these types of structures/apparatuses/systems, but that may unnecessarily obscure some significant aspects of the presently disclosed technology, are not set forth in the following description for purposes of clarity. Furthermore, although the following disclosure sets forth several representative embodiments of different aspects of the disclosed technology, several other embodiments can have different configurations and/or different components than those described in this section. Accordingly, the disclosed technology may include other embodiments with additional elements not described below with reference to FIGS. 1-3, 4B-5B, and 6B-8, and/or without several of the elements described below with reference to the foregoing figures.

Figure 1:
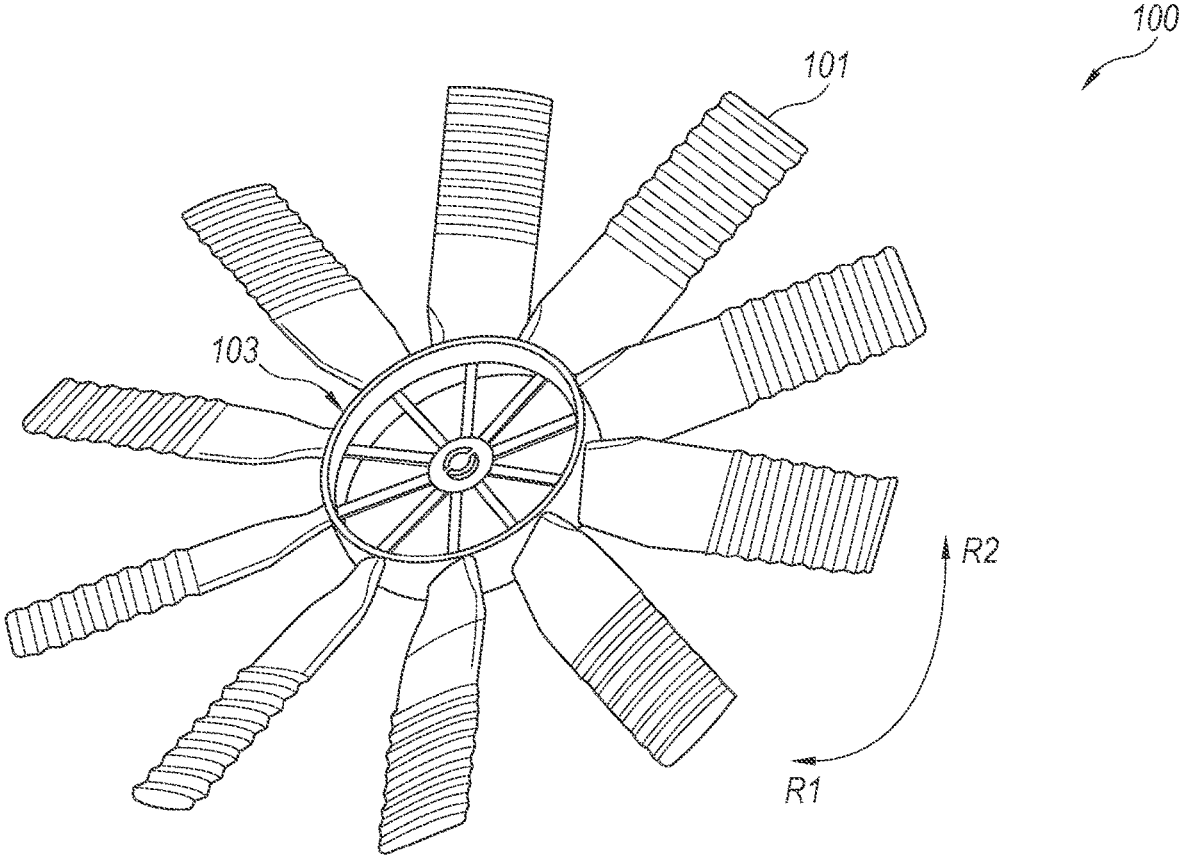
FIG. 1 is a partially schematic, isometric illustration of a fan having blades structured in accordance with embodiments of the present technology.

FIG. 1 is a partially schematic, isometric illustration of a representative fan 100 configured in accordance with embodiments of the present technology. In the illustrated embodiments, the fan 100 includes multiple fan blades 101 (e.g., ten) arranged circumferentially around, and coupled to, a hub 103. In some embodiments, the hub 103 can be driven or rotated by a motor, an engine, or another suitable device. Accordingly, the fan blades 101 can be rotated to generate a flow of air (or other types of fluid). In some embodiments, the hub 103 can be rotated by fluid passing over the fan blades 101 (e.g., pushing the fan blades 101) so as to be operated as a generator or other power output device. In some embodiments, the fan 100 can rotate in (rotational) direction R1 or R2, so as to move air/fluid in different directions.

Figure 2A:
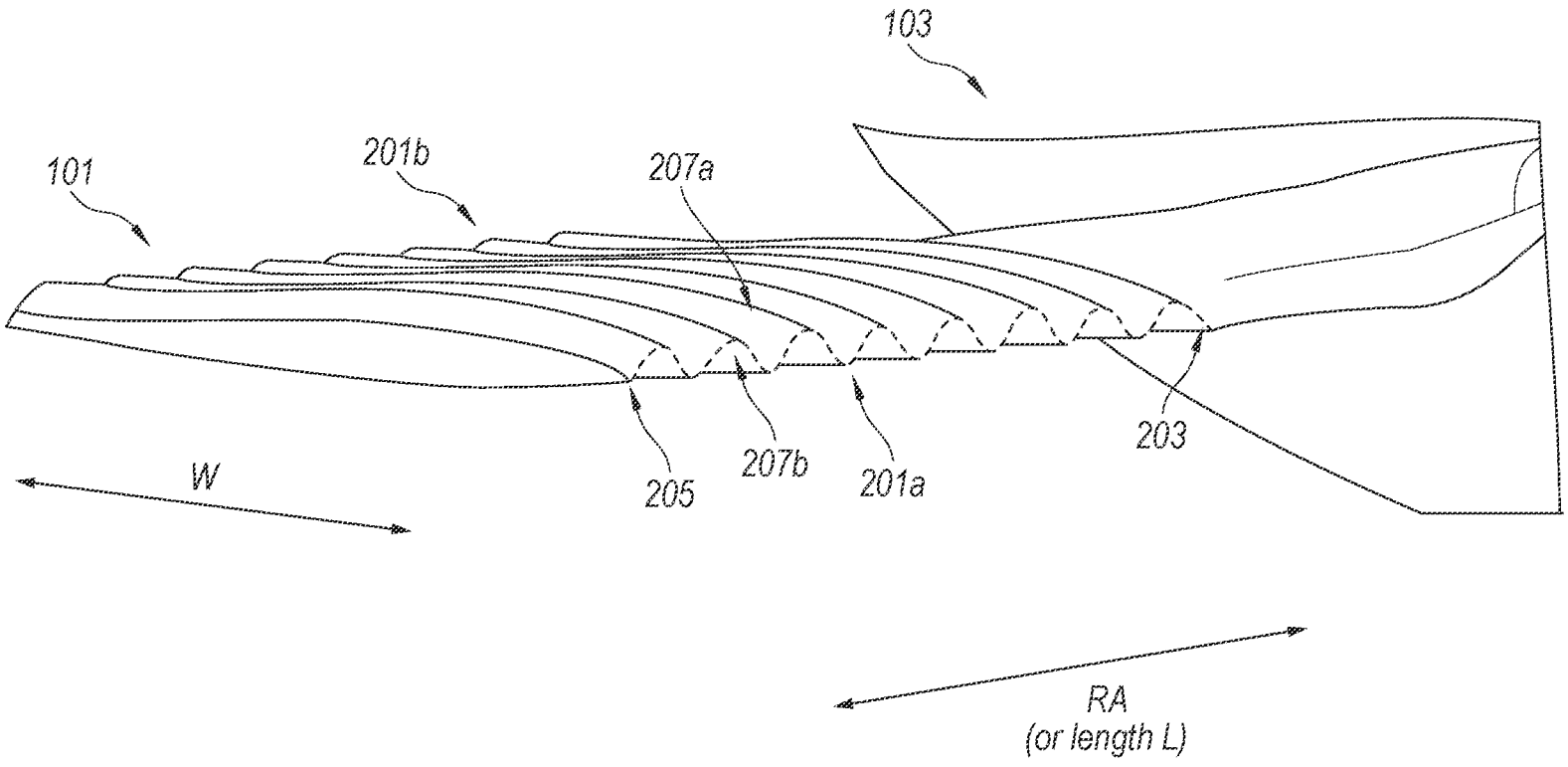
FIG. 2A is a partially schematic, isometric view of a fan blade configured in accordance with embodiments of the present technology.

FIG. 2A is a partially schematic, isometric view of a representative fan blade 101 configured in accordance with embodiments of the present technology. As shown, the fan blade 101 includes a first curved edge 201*a* (e.g., a leading edge) and a second curved edge 201*b* (e.g., a trailing edge). The shape of one or both of the edges, 201*a*, 201*b*, when viewed head-on, can be, or can approximate, a sine wave. The first and second curved edges 201*a*, 201*b* extend along a radial direction, as indicated, from a starting point 203 at, near, toward, or adjacent to the hub 103, outwardly to or toward a tip 205 of the fan blade 101, defining a length L of the curved edges. The curved edges 201*a*, 201*b* are continuously and smoothly formed. In the illustrated embodiments, the curved edges 201*a*, 201*b* are formed based on a sine wave. In other embodiments, however, the edges 201*a*,

201*b* can be formed based on multiple sine waves (embodiments to be discussed below with reference to FIG. 7), and/or based on other wave shapes. In some embodiments, when the fan blade 101 rotates, the first curved edge 201*a* can be a leading edge, and the second curved edge 201*b* can be a trailing edge. In some embodiments, however, when the fan blade 101 rotates in the opposite direction, the first curved edge 201*a* can be a trailing edge, and the second curved edge 201*b* can be a leading edge.

As shown, the fan blade 101 includes multiple upper channels 207*a* and lower channels 207*b*. The upper channels 207*a* and the lower channels 207*b* extend from the first curved edge 201*a* to the second curved edge 201*a* along the width W of the fan blade 101. The upper channels 207*a* and the lower channels 207*b* are configured to direct airflow passing along the upper and the lower surfaces, respectively, of the fan blade 101. Embodiments of the upper and lower channels 207*a*, 207*b* are described in greater detail later with reference to FIGS. 4B and 6B.

Figure 2B:
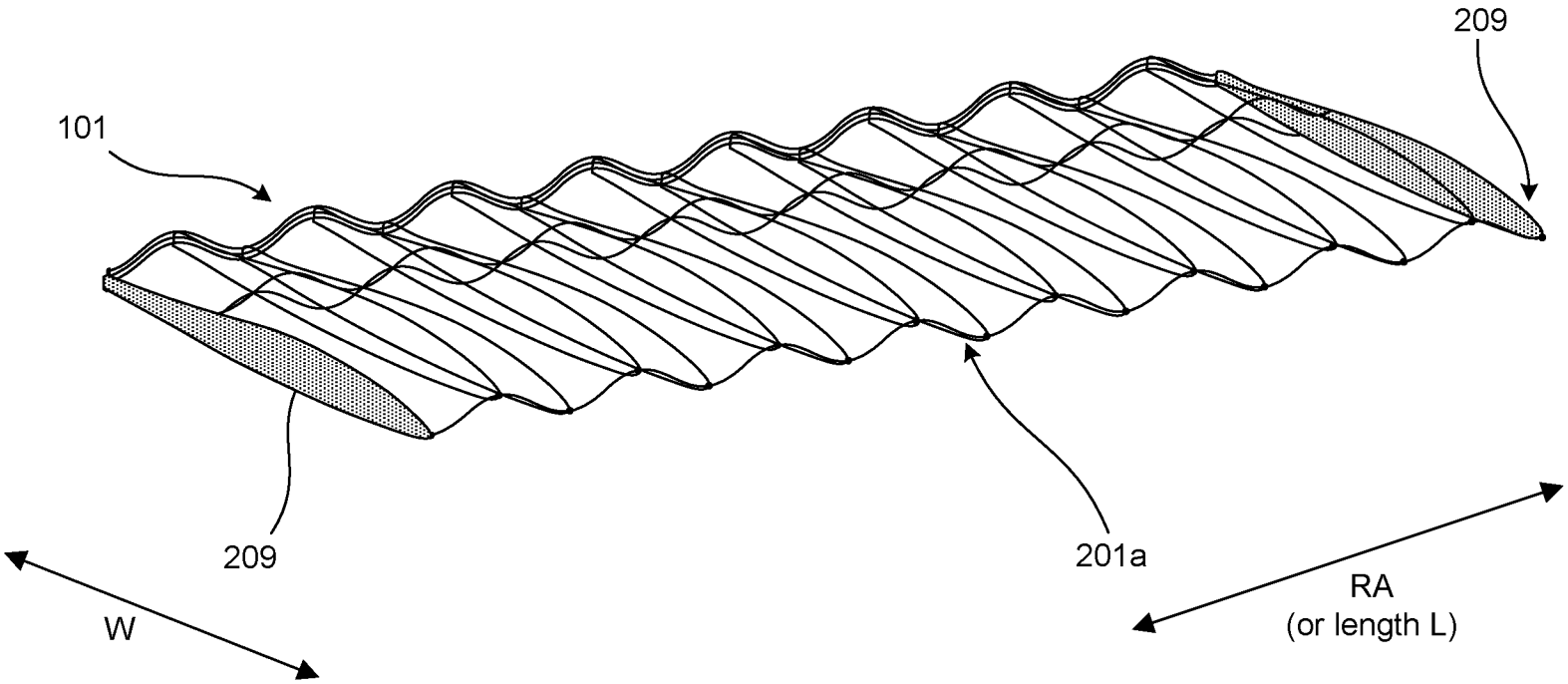
FIG. 2B is a partially schematic, isometric wireframe view illustrating a profile of a fan blade configured in accordance with embodiments of the present technology.

FIG. 2B is a partially schematic, isometric view illustrating a blade profile (or airfoil section) 209 of a fan blade 101 configured in accordance with representative embodiments of the present technology. As shown, the blade profile 209 remains generally the same in a radial direction RA, moving "up" and "down" according to the sine wave shape associated with the first curved edge 201*a* (and/or the second curved edge 201*b*). In some embodiments, the blade profile 209 of the fan blade 101 can change along the radial direction RA. In some embodiments, the blade profile 209 can "rotate" along the radial direction RA (see e.g., FIG. 8), to impart twist to the fan blade 101. In any of these embodiments, the continuous, smooth fan blade surface design can provide desirable aerodynamic characteristics for the fan blade 101. Accordingly, the disclosed fan blade design can effectively reduce and/or mitigate noise, vortices, and/or turbulence caused by airflow passing over and/or under the fan blade 101.

As shown in FIG. 2B, the size and shape of the blade profile 209 can remain constant across the fan blade 101, in at least some embodiments. This provides sufficient structural rigidity to the fan blade 101 and maintains the aerodynamic features provided by the blade profile or airfoil 209 throughout at least the curved portion of the fan blade 101.

Figure 3:
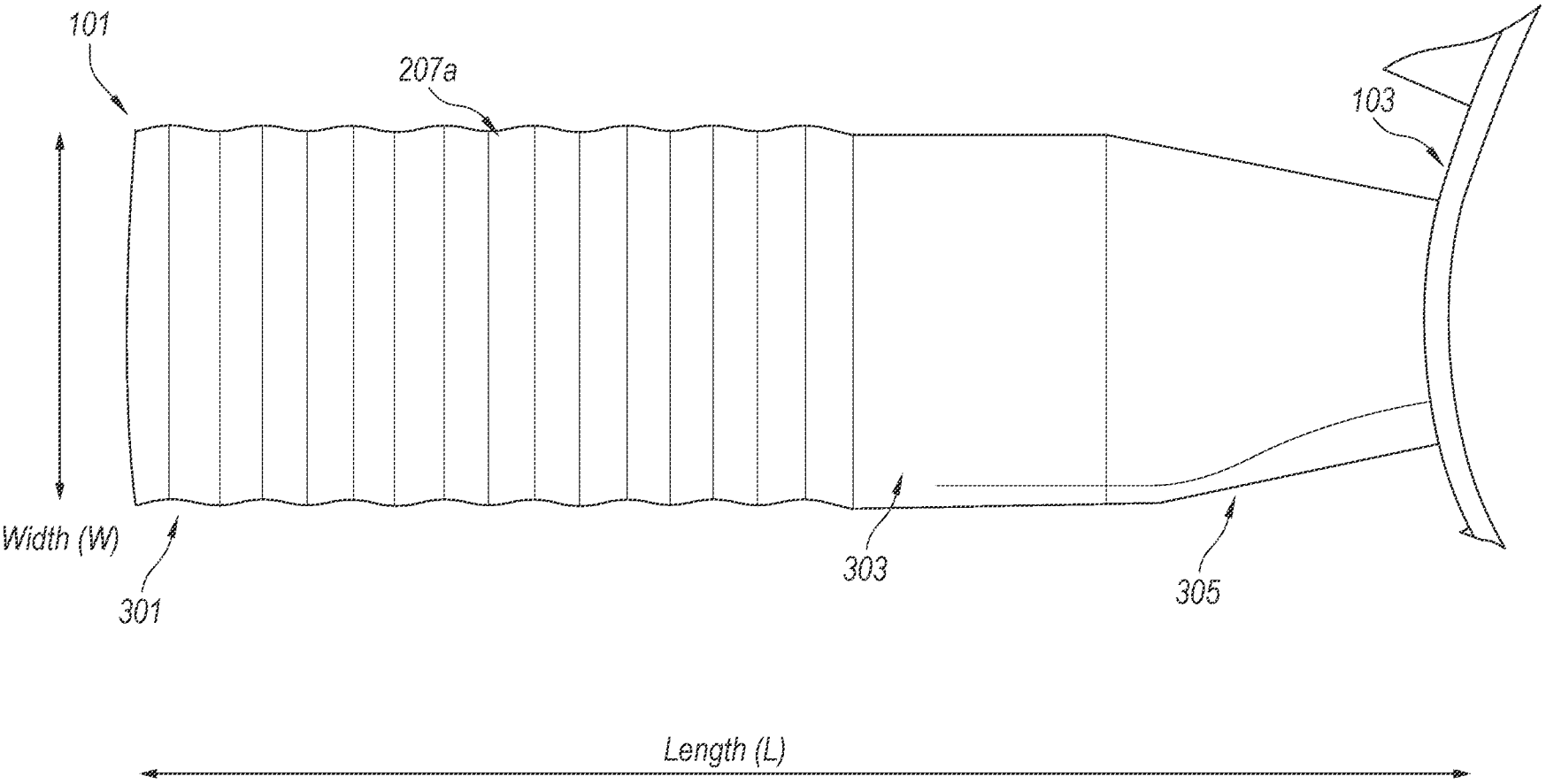
FIG. 3 is a partially schematic, top view of a fan blade configured in accordance with embodiments of the present technology.

FIG. 3 is a partially schematic, top view of a representative fan blade 101 configured in accordance with embodiments of the present technology. As shown, the fan blade 101 includes a first (or tip) section 301, a second (or middle) section 303, and a third (hub or root) section 305. The multiple upper channels 207*a* (and the lower channels 207*b*, not visible in FIG. 3) are positioned in the first section 301. In the second section 303, the edges of the fan blade 101 are "flat" (e.g., not curved in the manner of the first section 301, but still retaining an airfoil shape in profile). The width W of the fan blade 101 can be generally the same in the first and second sections 301, 303. In the third section 305, the width of the fan blade 101 can gradually be decreased in a direction RA toward the hub 103. The overall blade length L1 includes the lengths of all of the above three sections.

In some embodiments, the sizes of the first, second, and third sections 301, 303, and 305 can be adjusted based on various factors such as an expected rotation speed of the hub 103, the shape of the fan blade 101 (e.g., whether the edges are formed from single or multiple sine waves, the amplitude of the sine wave, etc.).

Figures 4A, 4B:
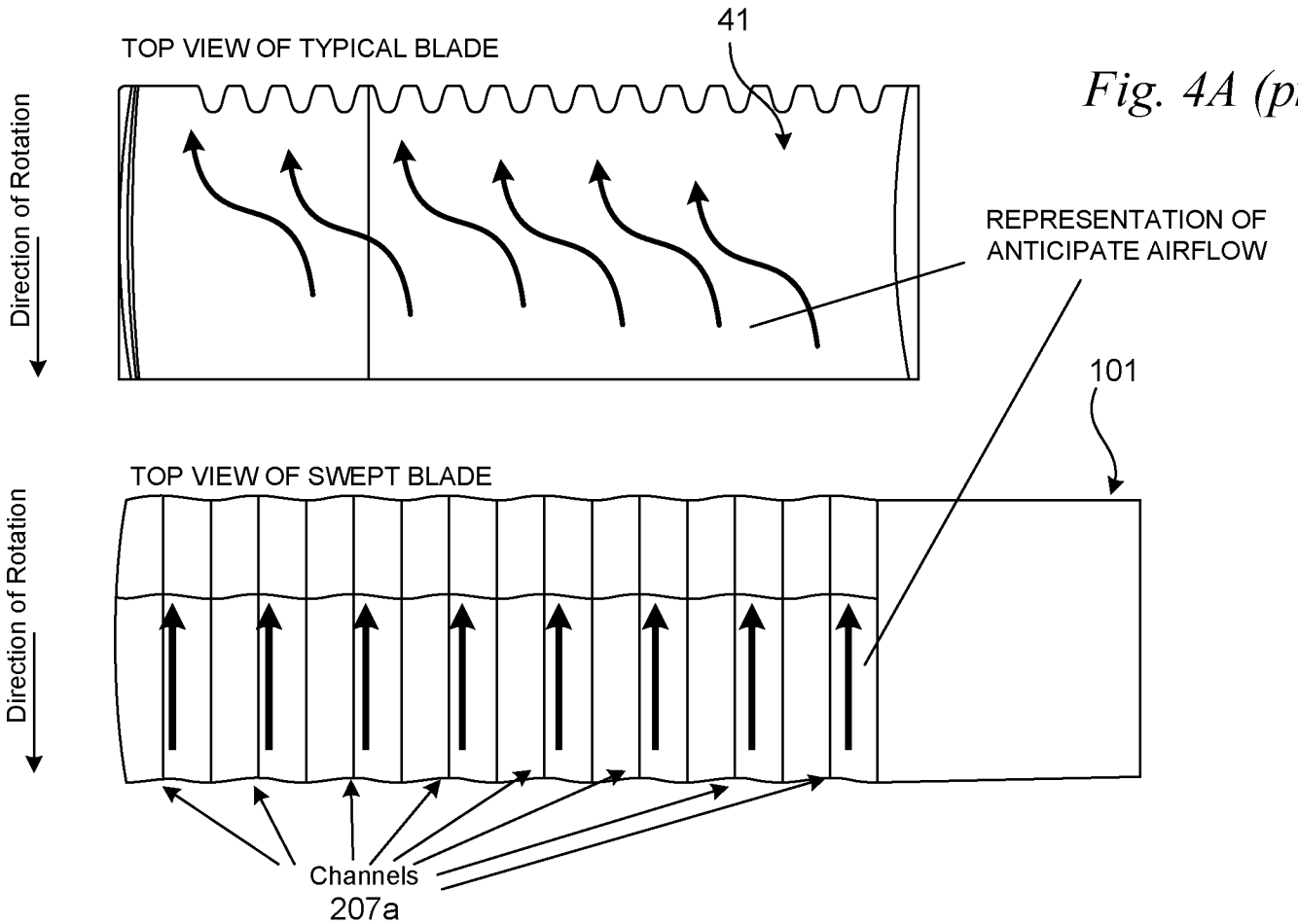
Fig. 4A (prior art)
FIG. 4A is a partially schematic, top view of a conventional blade.
FIG. 4B is a partially schematic, top view of a fan blade configured in accordance with embodiments of the present technology.

FIG. 4A is a partially schematic, top view of a conventional blade 41. FIG. 4B is a partially schematic, top view of a representative fan blade 101 configured in accordance with embodiments of the present technology. As shown in FIG. 4A, when the conventional blade 41 rotates (without any upper channels 207*a* or lower channels 207*b*), uneven airflow can be generated. By contrast, as shown in FIG. 4B, when the curved fan blade 101 rotates, the adjacent airflow can be directed by the upper channels 207*a* (and the lower channels 207*b*, not visible in FIG. 4B). As a result, the directed airflow can be generally uniform (e.g., with a reduced or zero component in the radial, outward direction) such that the fan blade 101 provides more uniform airflow and/or cooling than does the conventional blade 41.

Tables 1-6 below show comparisons of test results between a conventional blade and an improved fan blade (e.g., generally similar to the fan blade 101 shown in FIG. 1) of the present disclosure. In these tables, a "puller" configuration refers to a configuration where a fan including the blades to be tested is positioned downstream of a radiator. In other words, in the puller configuration, the fan is configured to pull air through the radiator. A "pusher" configuration refers to a configuration where a fan including the blades to be tested is positioned upstream of a radiator. In other words, in the pusher configuration, the fan is configured to push air through the radiator.

Efficiencies shown in the following tables are mechanical efficiencies (MEs), which can be calculated based on respective power inputs and power outputs. In some embodiments, the MEs can be calculated based on volumes of airflow, airflow pressure, and consumed power. For example, the mechanical efficiency can be calculated by Equation A below.

$$ME=(CFM\times TP)/(6356\times BHP) \quad (A)$$

In Equation (A) above, "CFM" represents the flow rate of an airflow ("cubic feet per minute"), "TP" represents total pressure of the airflow (the sum of static pressure "SP" and velocity pressure "VP"), "BHP" represents brake horsepower (e.g., the fan's power consumption), and "6356" is a constant. Via Equation (A), the ME of a fan can be calculated by measuring its flow rate, total pressure, and brake horsepower.

In Tables 1, 2, 3, and 6, the conventional fan had straight blades with winglets. In Tables 4 and 5, the conventional fan had straight blades with no winglets. The motor coupled to the conventional fan and the improved fan was either a 140-Watt motor (Tables 1, 2, 4, and 5) or a 200-Watt motor (Tables 3 and 6).

TABLE 1

| Test configuration Pusher 140 W motor | Conventional blades (Straight blades with a winglet) | Improved blades (Current design) |
|---|---|---|
| Airflow | X cfm | (X + 45) cfm |
| Current | A amps | (A − 0.1) amps |
| Efficiency | 21% | 23% |

In Table 1, a first test result of a fan in a "pusher" configuration shows that fan blades in accordance with the present disclosure can generate a higher flow volume than conventional blades while consuming less current. As a result, the fan with the improved blades has a higher efficiency than one having the conventional blades.

TABLE 2

| Test configuration Puller 140 W motor | Conventional blades (Straight blades with a winglet) | Improved blades (Current design) |
|---|---|---|
| Airflow | X cfm | (X + 40) cfm |
| Current | A amps | (A − 0.3) amps |
| Efficiency | 22% | 24% |

In Table 2, a second test result of a fan in a "puller" configuration shows that fan blades in accordance with the present disclosure can generate a higher flow volume than the conventional blades, and draw less current. As a result, the fan with the improved blades has a higher efficiency than one having the conventional blades.

TABLE 3

| Test configuration Puller 200 W motor | Conventional blades (Straight blades with a winglet) | Improved blades (Current design) |
|---|---|---|
| Airflow | X cfm | (X + 112) cfm |
| Current | A amps | (A − 0.2) amps |
| Efficiency | 22% | 25% |

In Table 3, a third test result of a fan in a "puller" configuration shows that fan blades in accordance with the present disclosure can generate a higher flow volume than the conventional blades, and draw less current. As a result, the fan with the improved blades has a higher efficiency than one having the conventional blades.

TABLE 4

| Test configuration Pusher 140 W motor | Conventional blades (Straight blades) | Improved blades (Current design) |
|---|---|---|
| Airflow | X cfm | (X + 47) cfm |
| Current | A amps | (A + 0.4) amps |
| Efficiency | 22% | 23% |

In Table 4, a fourth test result of a fan in a "pusher" configuration shows that fan blades in accordance with the present disclosure can generate a higher flow volume than the conventional blades, with a slightly higher current draw. The fan with the improved blades produced a higher overall efficiency than one having the conventional blades.

TABLE 5

| Test configuration Puller 140 W motor | Conventional blades (Straight blades) | Improved blades (Current design) |
|---|---|---|
| Airflow | X cfm | (X + 160) cfm |
| Current | A amps | A amps |
| Efficiency | 19% | 24% |

In Table 5, a fifth test result of a fan in a "puller" configuration shows that fan blades in accordance with the present disclosure can generate a higher flow volume than the conventional blades, while drawing generally the same current. Therefore, the fan with the improved blades has a higher efficiency than one having the conventional blades.

TABLE 6

| Test configuration Puller 200 W motor | Conventional blades (Straight blades with a winglet) | Improved blades (Current design) |
|---|---|---|
| Airflow | X cfm | (X + 199) cfm |
| Current | A amps | (A − 1.1) amps |
| Efficiency | 19% | 25% |

In Table 6, a sixth test result of a fan in a "puller" configuration shows that fan blades in accordance with the present disclosure can generate a higher flow volume than the conventional blades, while drawing less current. Therefore, the fan with the improved blades has a higher efficiency than one having the conventional blades.

According to the test results shown in Tables 1-6, a fan with the improved blades of the present disclosure generally provides higher airflow while drawing less current.

Referring to both FIG. 2A and FIG. 4B, the dimensions of the upper/lower channels 207*a*, 207*b* correspond to the curved edges 201*a*, 201*b*. In some embodiments, the multiple upper channels 207*a* along the radial direction RA can have generally the same dimension, and the lower channels 207*b* along the radial direction RA can have generally the same dimension. In some embodiments, the upper channels 207*a* can have generally the same dimension as the lower channel 207*b*. In such embodiments, the curved edges 201*a*, 201*b* have substantially the same or very similar dimensions.

In some embodiments, however, the curved edges 201*a*, 201*b* can have different dimensions (e.g., via different combinations of sine waves). In such embodiments, the dimensions of the upper and/or lower channels 207*a*, 207*b* can be different. For example, one of the upper channels 207*a* can have a broader opening at the first curved edge 201*a* and have a narrower opening at the second curved edge 201*b*, or vice versa. In some embodiments, two adjacent upper channels 207*a* can have different dimensions. In some embodiments, two adjacent lower channels 207*b* can have different dimensions.

Figure 4C:
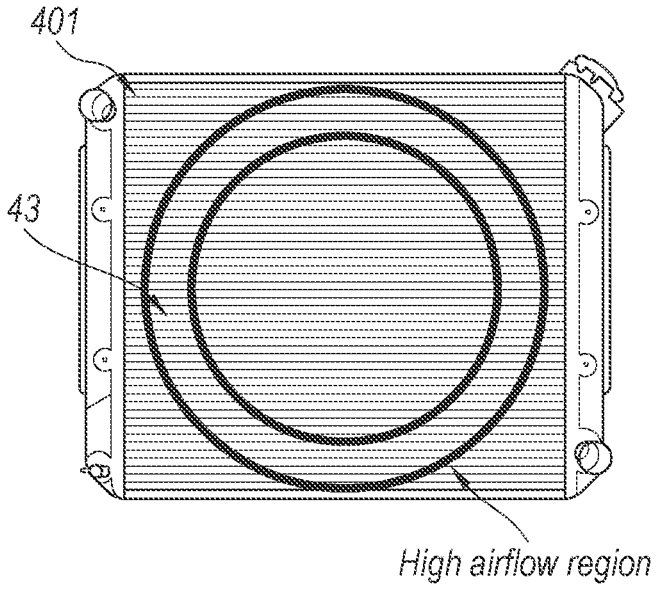
Fig. 4C (Prior Art)
FIGS. 4C and 4D are partially schematic views of high airflow regions generated by conventional fan blades (FIG. 4C) and by fan blades configured in accordance with embodiments of the present technology (FIG. 4D).
Figure 4D:
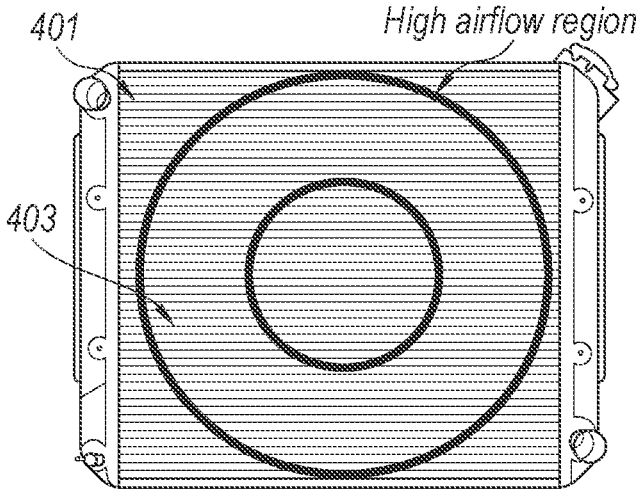

FIGS. 4C and 4D compare expected airflows through a radiator 401 having (1) a conventional fan (e.g., similar or the same as described above with respect to Tables 1-6) with conventional blades 41 (FIG. 4C) and, (2) a fan having curved blades 101 configured in accordance with the present technology (FIG. 4D). As shown in FIG. 4D, a high airflow region 403 (e.g., a region over which the airflow through the radiator 401 exceeds a threshold value) is expected to be larger than a corresponding region 43 that uses a conventional fan (FIG. 4C). It is expected that the greater "high-airflow" region 403 is at least partially caused by the upper and lower channels 207*a*, 207*b*, which can effectively direct airflow in a uniform, predetermined direction.

Figure 5A:
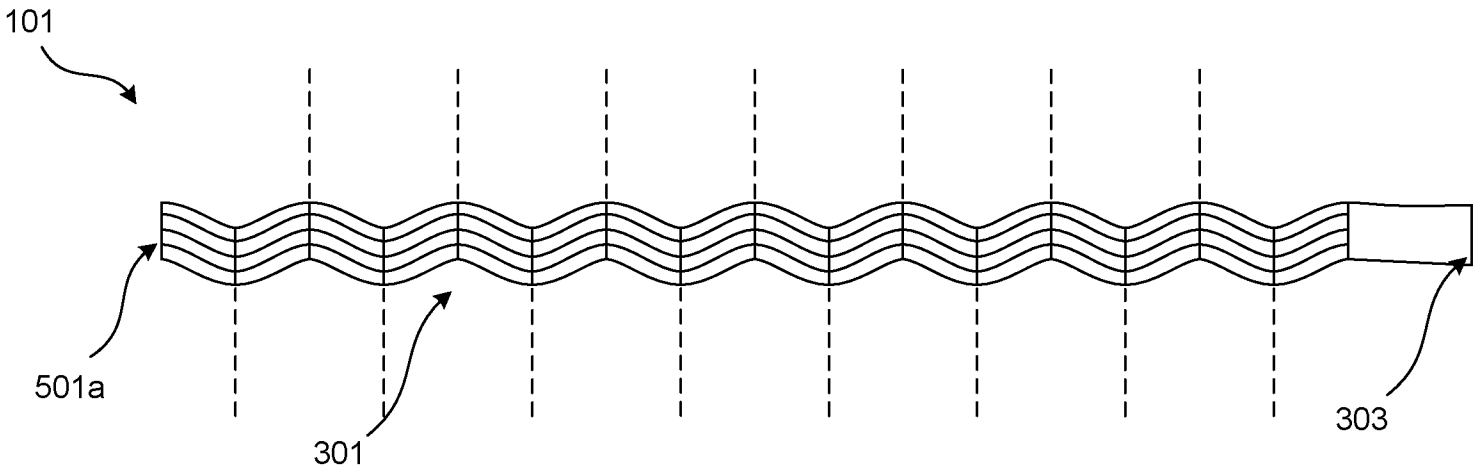
FIG. 5A is a partially schematic, side view of fan blades configured in accordance with embodiments of the present technology.
Figure 5C:
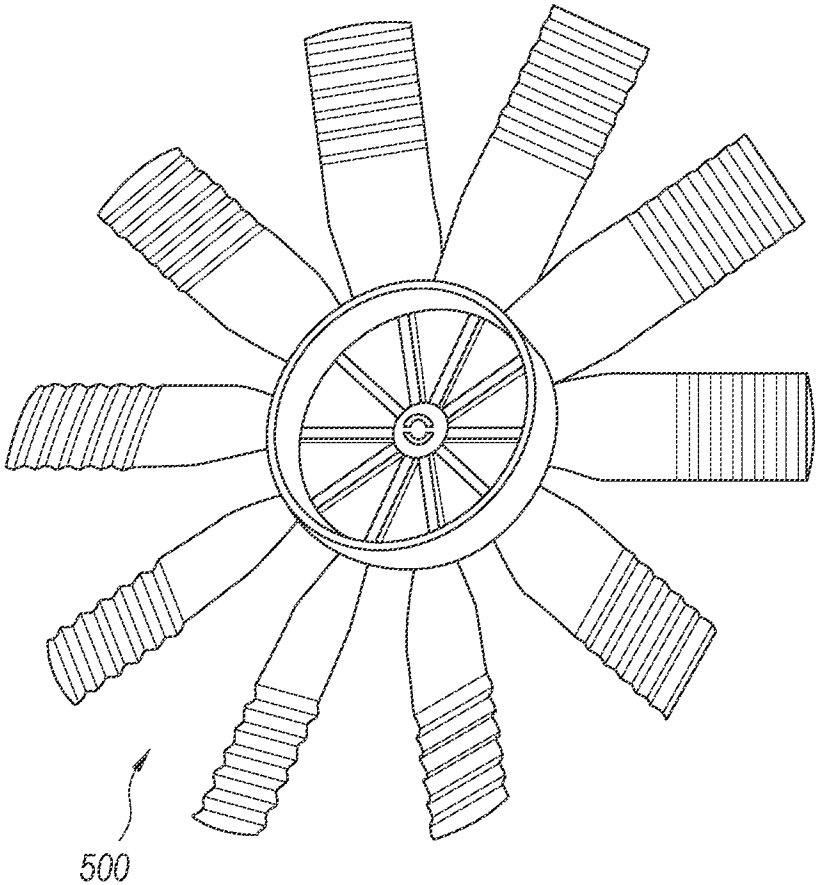
FIGS. 5B and 5C are partially schematic, isometric illustrations of two fan blades having different lengths/diameters.
Figure 5B:
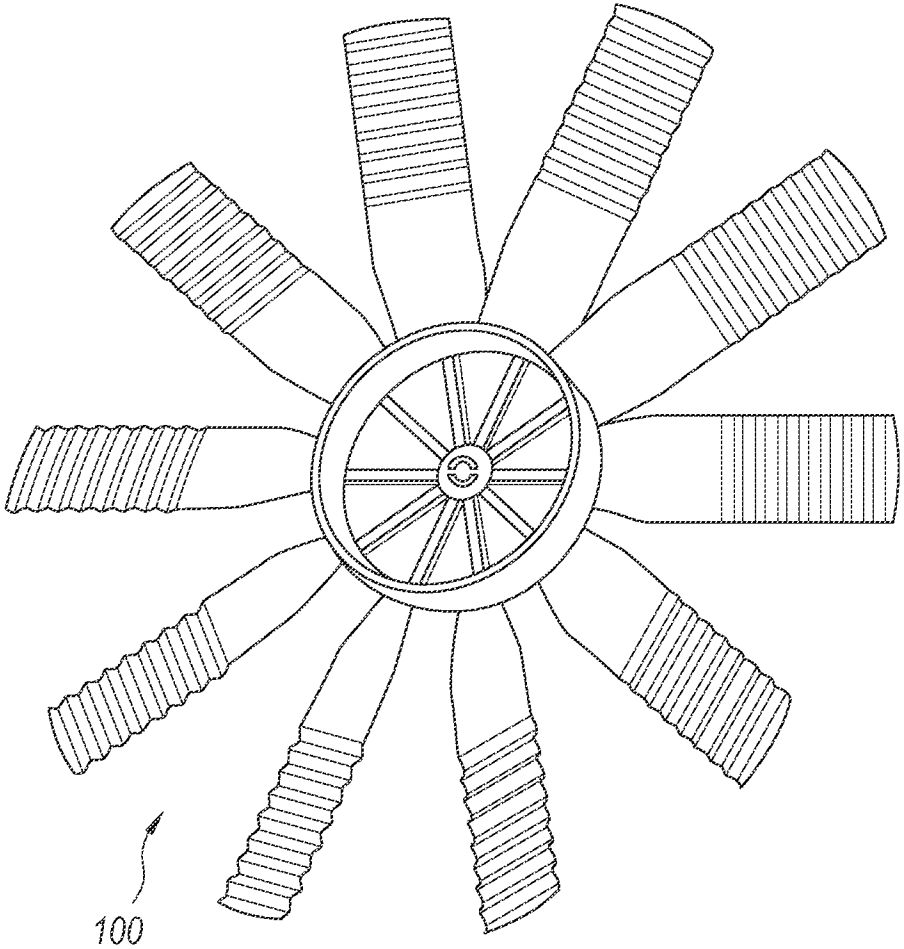

FIG. 5A is a partially schematic, side view of a representative fan blade 101 having an upward pointing tip 501*a* in accordance with embodiments of the present technology. In other embodiments, the fan blade 101 can have a downward-facing tip, or a "neutral" or "flat" tip (e.g., neither upward-facing nor downward-facing). Advantages of the disclosed fan blade include that its upward-facing tip 501*a* or downward-facing tip can function as a winglet (e.g., to reduce tip vortices). This winglet function can result from the "wavy" shape of the fan blade, eliminating the need to add an additional winglet to the fan blade 101. The blade can have (e.g., be cut to) different lengths (e.g., at locations indicated by dashed lines shown in FIG. 5A) to make smaller diameter fans that still have a winglet formed at the tip dur to the "wavy" shape. FIG. 5B is a partially schematic, isometric illustration of a representative fan 100. FIG. 5C is a partially schematic, isometric illustration of a similar fan 500 to that shown in FIG. 5B with the blades cut down or otherwise formed to make a smaller length/diameter fan. Benefits of these features include relatively fast, simple, and cost-effective manufacturing processes when making the blades and/or cutting a blade for smaller diameter fans.

Figure 6A:
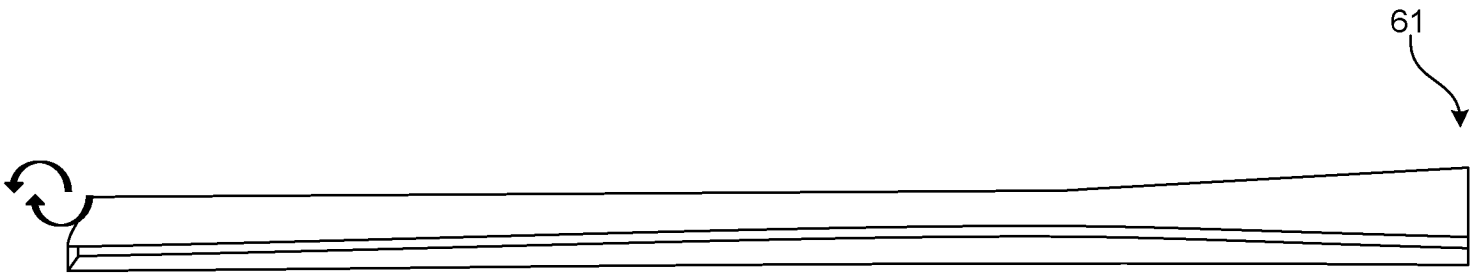
Fig. 6A (Prior art)
FIG. 6A is a partially schematic, side view of a conventional blade.
Figure 6B:
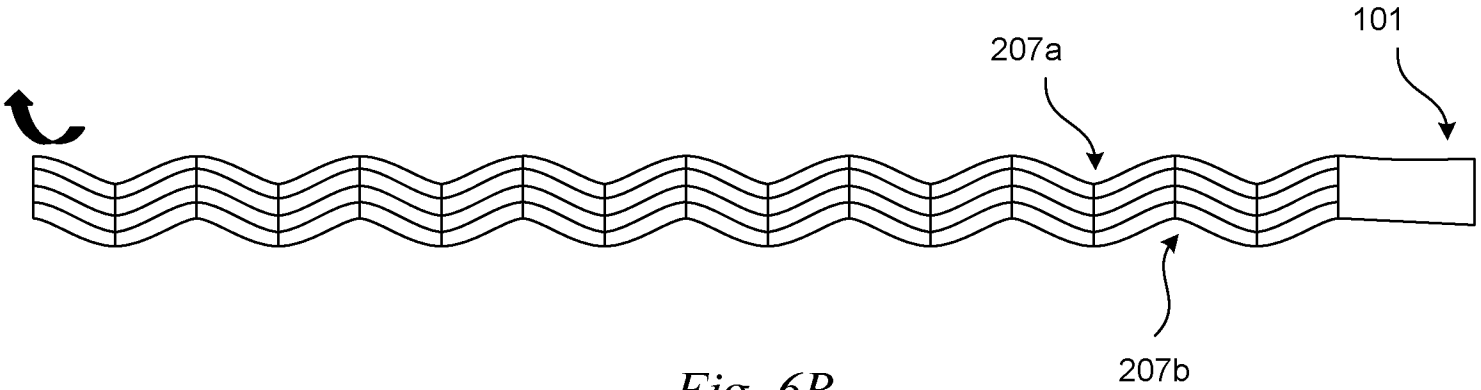
FIG. 6B is a partially schematic, side view of a fan blade configured in accordance with embodiments of the present technology.

FIG. 6A is a partially schematic, side view of a conventional blade 61. FIG. 6B is a partially schematic, side view of a fan blade 101 configured in accordance with embodiments of the present technology. As shown in FIG. 6A, when the conventional flat blade 61 rotates, vortices are formed at the blade tip which can cause undesirable noise and/or turbulence. By contrast, when the curved or "sine-waved" fan blade 101 rotates, the upper channel 207*a* and the lower channel 207*b* form winglets so as to reduce the vortex generation nearby. Accordingly, undesirable turbulence can be mitigated.

Figure 7:
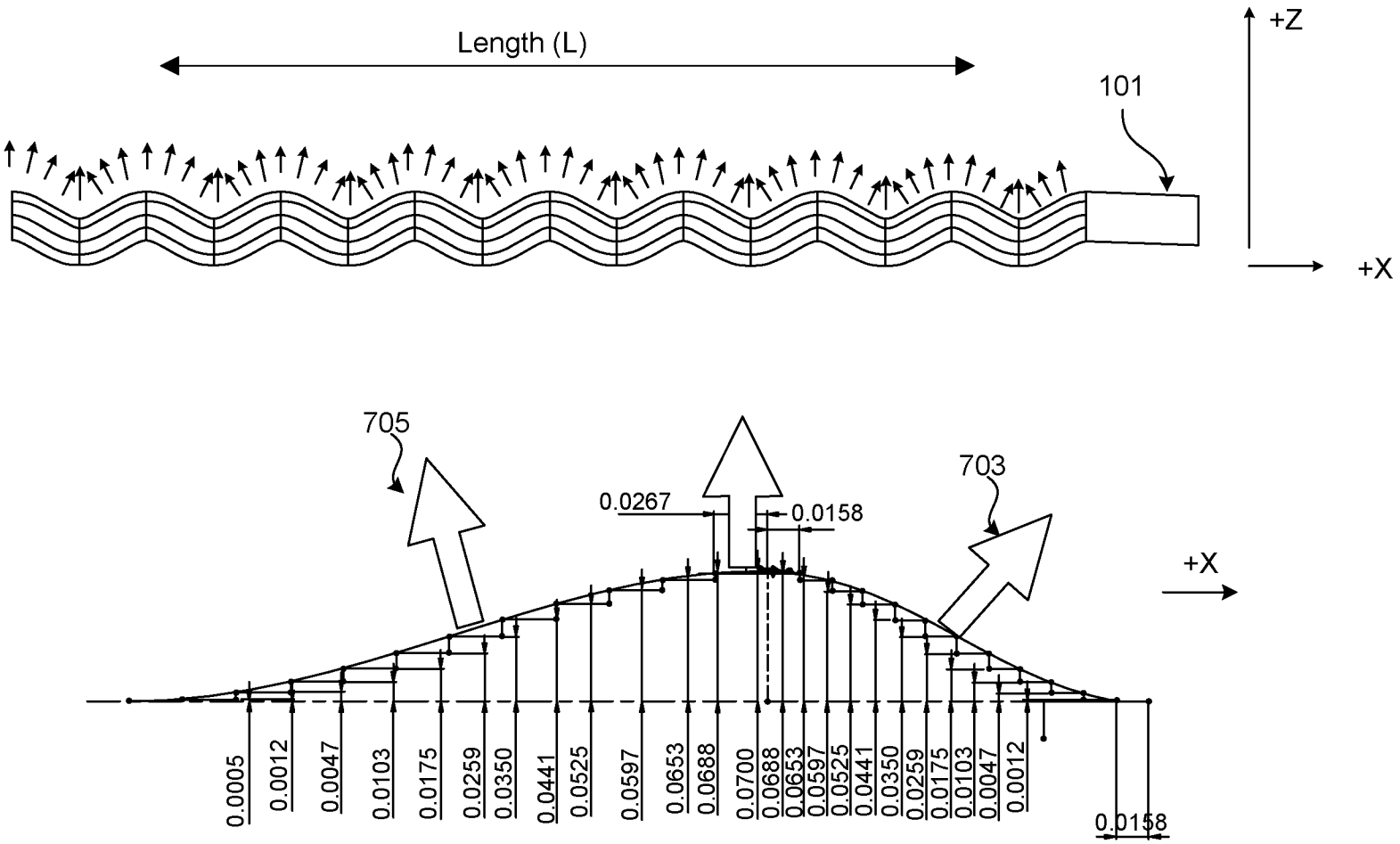
FIG. 7 is a diagram illustrating a result of combining two sine waves with different wavelengths to produce fan blade edges in accordance with embodiments of the present technology.

In some embodiments, the fan blade 101 can be designed based on a combination of multiple waves. For example, FIG. 7 illustrates the result of combining two sine waves with different wavelengths so as to form a combined wave that is asymmetric. The combined wave can be used to form the edges of the fan blade 101. In some embodiments, a fan blade can be designed/formed to direct airflow in specific directions 703, 705. For example, if a designer wants to direct air preferentially in a first direction 703 over a second direction 705, the designer can skew the combined wave toward the first direction 703. In some embodiments, the fan blade 101 can be designed/formed by combining more than two waves (e.g., sine waves and/or other suitable waves) having different wavelengths.

Figure 8:
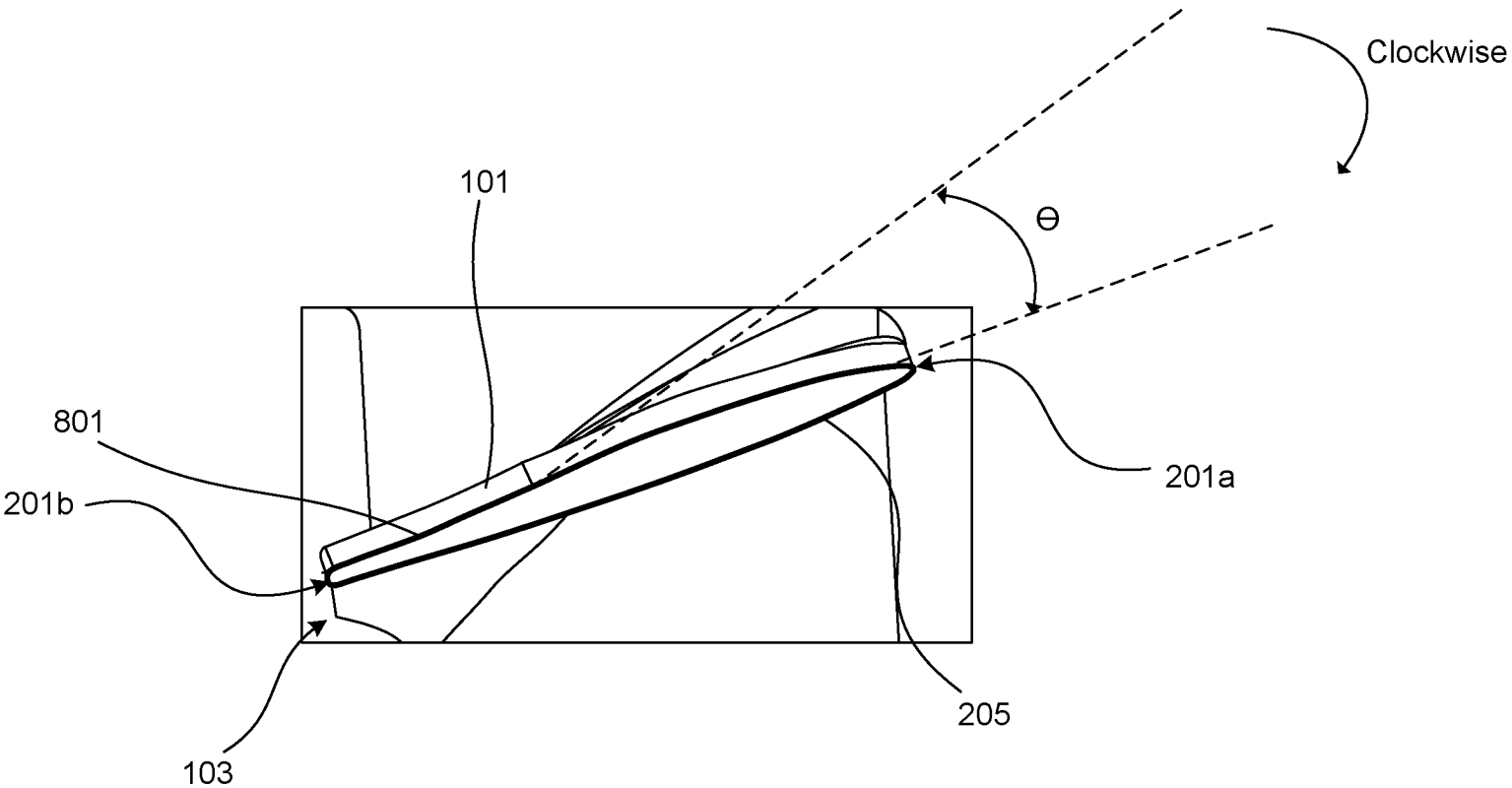
FIG. 8 is a partially schematic side view of a fan blade configured in accordance with embodiments of the present technology.

FIG. 8 is a partially schematic side view of a representative fan blade 101, illustrating an aerodynamic profile 801 of the blade in accordance with embodiments of the present technology. As shown in FIG. 8, the profile 801 can rotate "clockwise" from the hub 103 to the tip 205. Accordingly, the blade profile at the hub 103 can form an angle Θ with the blade profile at the tip 205. In some embodiments, the fan blade can be formed by rotating "counter-clockwise." In any of these embodiments, rotating the profile provides twist to the blade 101.

The present fan blade 101 with a "wavy" design can effectively direct airflow in a more streamwise manner. It is believed that curved leading and trailing edges, with corresponding upper and lower channels can effectively reduce turbulence along at least the curved length of the fan blade 101, if not an even greater portion of the overall length of the blade. As a result, the blade is expected to perform more efficiently.

Figure 9:
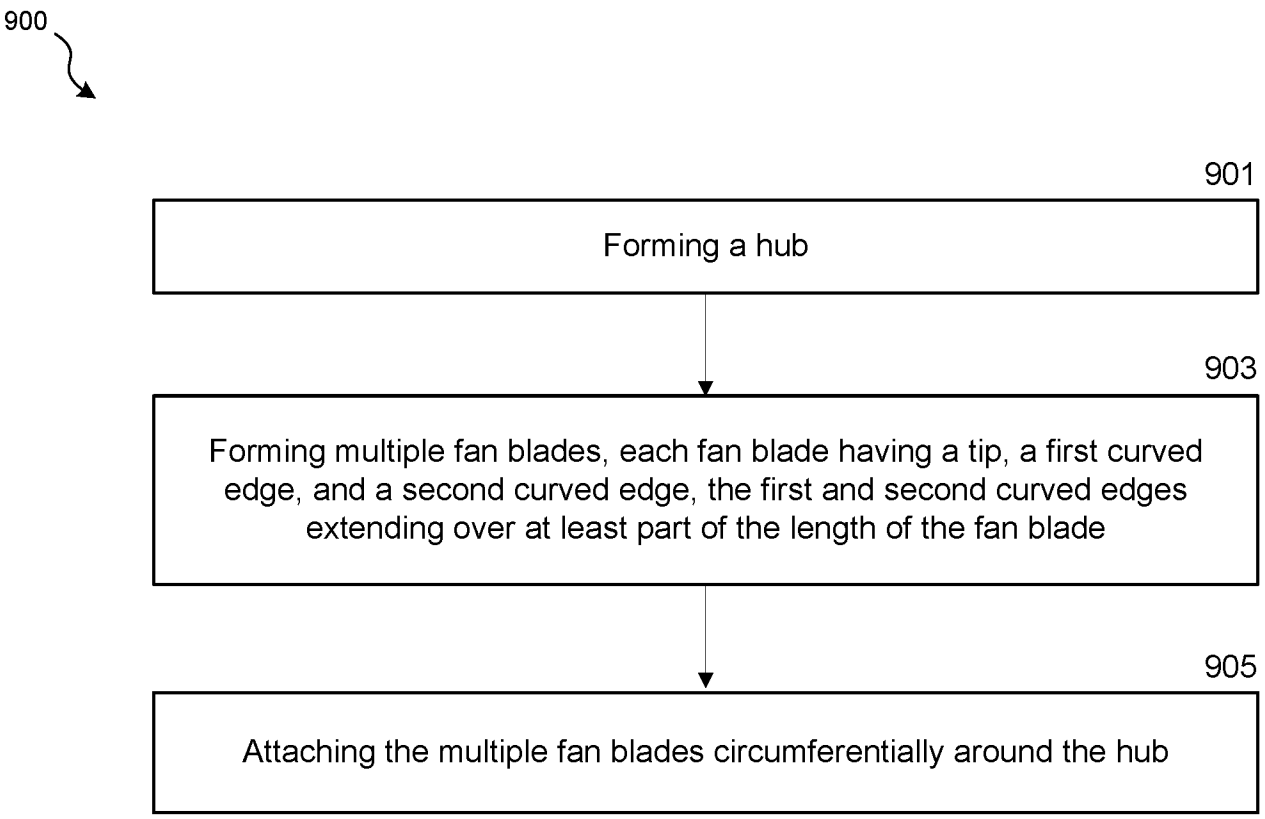
FIG. 9 is a flowchart illustrating a method in accordance with embodiments of the present technology.

FIG. 9 is a flowchart illustrating a method 900 in accordance with embodiments of the present technology. At block 901, the method 900 includes forming a hub. At block 903, the method 900 includes forming multiple fan blades. In some embodiments, each fan blade can have a tip, a first curved edge, and a second curved edge. In some embodiments, the first and second curved edges can extend over at least part of the length of the fan blade. In some embodiments, for example, the first and second curved edges can extend from 50% to 90% of the length of the fan blade. At block 905, the method 903 includes attaching the multiple fan blades circumferentially around the hub.

In some embodiments, forming the multiple fan blades includes forming each of the fan blades with multiple upper channels and multiple lower channels. In some embodiments, the multiple upper channels (and/or the lower channel) can extend from the first curved edge to the second curved edge. In some embodiments, the fan blades can have other suitable shapes and configurations.

One advantage of embodiments of the present technology is that the fan blade can be customized to fit the needs of various types of air-moving (and/or air-driven) devices. Another advantage of embodiments of the present technology is that fan blade systems can include modular components (e.g., fan blades with different curved or sine-waved shapes) that are easy to install and/or maintain. An overarching result of any one or combination of the foregoing features is that the fan blades of the present technology can be more efficient, less noisy, and/or more flexible than conventional blades.

From the foregoing, it will be appreciated that specific embodiments of the technology have been described herein for purposes of illustration, but that various modifications may be made without deviating from the technology. For example, in some embodiments, the fan blade can be formed based on repetitive or periodic waves other than sine waves.

Certain aspects of the technology described in the context of particular embodiments may be combined or eliminated in other embodiments. Further, while advantages associated with certain embodiments of the technology have been described in the context of those embodiments, other embodiments may also exhibit such advantages, and not all embodiments need necessarily exhibit such advantages to fall within the scope of the present technology. Accordingly, the present disclosure and associated technology can encompass other embodiments not expressly shown or described herein. The following example provides an additional embodiment of the disclosed technology.

To the extent any materials incorporated herein by reference conflict with the present disclosure, the present disclosure controls.

The invention claimed is:

1. A fan, comprising:

a hub; and multiple fan blades arranged circumferentially around, and coupled to, the hub, with each fan blade having a tip, a first curved edge, and a second curved edge, the first and second curved edges extending over at least part of the length between the hub and the tip of the fan blade, wherein the first curved edge extends in a length direction of the fan blade, and repetitively varies in a direction perpendicular to the length direction and a width direction of the fan blade, by an amount greater than any repetitive variation in both the width and length directions;

wherein each of the fan blades is formed with multiple upper channels and multiple lower channels;

wherein the multiple upper channels extend from the first curved edge to the second curved edge; and wherein the multiple lower channels extend from the first curved edge to the second curved edge.

2. The fan of claim 1, wherein the first curved edge has a sine-wave shape.

3. The fan of claim 1, wherein the second curved edge has a sine-wave shape.

4. The fan of claim 1, wherein the first curved edge has a first sine-wave shape, and wherein the second curved edge has a second sine-wave shape, and wherein the first and second sine-wave shapes have the same wavelength and amplitude.

5. The fan of claim 1, wherein the hub is configured to be rotated either in a first rotational direction or a second rotational direction opposite the first rotational direction.

6. The fan of claim 1, wherein a shape of the first curved edge is formed from multiple sine waves.

7. The fan of claim 6, wherein the multiple sine waves have the same amplitude.

8. The fan of claim 1, wherein a shape of the first curved edge is formed from a first set of sine waves, and wherein a shape of the second curved edge is formed from a second set of sine waves.

9. The fan of claim 8, wherein each sine wave of the first and second sets of sine waves has the same amplitude.

10. The fan of claim 1, wherein each of the fan blades includes a first section, a second section, and a third section, and wherein the third section is coupled to the hub.

11. The fan of claim 10, wherein the first section has a first width, and wherein the third section has a third width different than the first width.

12. The fan of claim 10, wherein the first section has a first width, and wherein the second section has a second width different than the first width.

13. The fan of claim 10, wherein the first curved edge is in the first section and the second section.

14. The fan of claim 13, wherein the second curved edge is in the first section and the second section.

15. A fan, comprising:

a hub; and multiple fan blades arranged circumferentially around, and coupled to, the hub, with each fan blade havinq a tip, a first curved edge, and a second curved edge, the first and second curved edges extending over at least part of the length between the hub and the tip of the fan blade;

wherein each of the fan blades is formed with multiple upper channels and multiple lower channels;

wherein the multiple upper channels extend from the first curved edge to the second curved edge;

wherein the multiple lower channels extend from the first curved edge to the second curved edge;

wherein a shape of the first curved edge is formed from multiple sine waves; and wherein the multiple sine waves include a first sine wave having a first amplitude and a second sine wave having a second amplitude, and wherein the first amplitude is different than the second amplitude.

16. A fan, comprising:

a hub; and multiple fan blades arranged circumferentially around, and coupled to, the hub, with each fan blade having a tip, a first curved edge, and a second curved edge, the first and second curved edges extending over at least part of the length between the hub and the tip of the fan blade;

wherein each of the fan blades is formed with multiple upper channels and multiple lower channels;

wherein the multiple upper channels extend from the first curved edge to the second curved edge;

wherein the multiple lower channels extend from the first curved edge to the second curved edge; and wherein a shape of the first curved edge is formed from a first set of sine waves and a second set of sine waves, and wherein the first set of sine waves and the second set of sine waves have different wavelengths.

17. A fan, comprising:

a hub; and multiple fan blades arranged circumferentially around, and coupled to, the hub, with each fan blade having a tip a first curved edge, and a second curved edge, the first and second curved edges extending over at least part of the length between the hub and the tip of the fan blade;

wherein each of the fan blades is formed with multiple upper channels and multiple lower channels;

wherein the multiple upper channels extend from the first curved edge to the second curved edge;

wherein the multiple lower channels extend from the first curved edge to the second curved edge;

wherein a shape of the first curved edge is formed from a first set of sine waves, and wherein a shape of the second curved edge is formed from a second set of sine waves; and wherein each sine wave of the first set of sine waves has a first amplitude, and wherein each sine wave of the second set of sine waves has a second amplitude different than the first amplitude.

18. A method for manufacturing a fan, comprising:

forming a hub;

forming multiple fan blades, each fan blade having a tip, a first curved edge, and a second curved edge, the first and second curved edges extending over at least part of the length of the fan blade; and attaching the multiple fan blades circumferentially around the hub;

wherein forming the multiple fan blades includes forming each of the fan blades with multiple upper channels and multiple lower channels, and wherein the first curved edge extends in a length direction of the fan blade, and repetitively varies in a direction perpendicular to the length direction and a width direction of the fan blade, by an amount greater than any repetitive variation in both the width and length directions.

19. The method of claim 18, wherein the multiple upper channels extend from the first curved edge to the second curved edge, and wherein the multiple lower channels extend from the first curved edge to the second curved edge.

* * * * *